US006394899B1

(12) United States Patent
Walker

(10) Patent No.: US 6,394,899 B1
(45) Date of Patent: May 28, 2002

(54) METHOD OF PLAYING A KNOWLEDGE BASED WAGERING GAME

(75) Inventor: Stephen Tobin Walker, 2815 N. Main Ave., San Antonio, TX (US) 78205

(73) Assignee: Stephen Tobin Walker, San Antonio, TX (US)

( * ) Notice: Subject to any disclaimer, the term of this patent is extended or adjusted under 35 U.S.C. 154(b) by 0 days.

(21) Appl. No.: 09/430,812

(22) Filed: Oct. 29, 1999

(51) Int. Cl.[7] ..... A63F 9/24

(52) U.S. Cl. ..... 463/9; 463/42; 273/460; 434/323; 434/332; 434/336

(58) Field of Search ..... 463/9, 42; 273/460; 434/323, 332, 336

(56) References Cited

U.S. PATENT DOCUMENTS

| | | | | |
|---|---|---|---|---|
| 4,582,324 | A | * | 4/1986 | Koza et al. |
| 4,593,904 | A | * | 6/1986 | Graves ..... 463/42 |
| 4,836,546 | A | * | 6/1989 | DeRie et al. |
| 5,035,422 | A | * | 7/1991 | Berman |
| 5,073,931 | A | * | 12/1991 | Audebert et al. |
| 5,332,218 | A | * | 7/1994 | Lucey |
| 5,393,057 | A | * | 2/1995 | Marnell, II |
| 5,539,822 | A | | 7/1996 | Lett |
| 5,718,429 | A | * | 2/1998 | Keller, Jr. |
| 5,759,101 | A | | 6/1998 | Von Kohorn |
| 5,772,512 | A | * | 6/1998 | Chichester |
| RE35,864 | E | | 7/1998 | Weingardt |
| 5,779,549 | A | * | 7/1998 | Walker et al. |
| 5,782,470 | A | * | 7/1998 | Langan |
| 5,899,456 | A | | 5/1999 | Weinstock et al. |
| 5,905,523 | A | * | 5/1999 | Woodfield et al. |
| 5,916,024 | A | | 6/1999 | Von Kohorn |
| 6,015,344 | A | * | 1/2000 | Kelly et al. |
| 6,193,606 | B1 | * | 2/2001 | Walker et al. |

OTHER PUBLICATIONS

"Electronic trivia game takes off in popularity" by Carol Rust Mar. 8, 1996 (admitted prior art).

* cited by examiner

*Primary Examiner*—Michael O'Neill

(57) ABSTRACT

A knowledge based wagering game affords a plurality of players an opportunity to place a wager on the game. A sequential series of questions is displayed to each player who must select a correct answer from a plurality of possible answers within a predetermined period of time. The answers selected by each player are recorded and the players are ranked with respect to all of the other players based on the number of correct answers selected and the amount of time taken to select the answers. Under a pari-mutuel betting system payouts are made in accordance with the players' relative scores.

23 Claims, 3 Drawing Sheets

METHOD OF PLAYING A KNOWLEDGE BASED WAGERING GAME

TECHNICAL FIELD

This invention relates to a wagering game and more particularly to a wagering game in which each player's winnings are based on that player's ability to correctly answer one or more trivia questions in the fastest time vis-a-vis the universe of competing players and the amount of money in the wager pool for that game.

BACKGROUND ART

Slot machines are well-known devices in the gaming industry. Typically, slot machines are computer controlled with video displays or are electro-mechanical devices having mechanically spinning reels controlled by a processor. The reels each have a plurality of different symbols or indicia. The machine will pay out based upon the alignment of the indicia on the reels along one or more pay lines. To play the machine, the player enters a wager in any fashion known in the art. Thereafter the player prompts the machine as by pressing a button or pulling a handle whereupon the electro-mechanical reels spin or the computer processor causes the video display to simulate spinning reels. When the slot machine is prompted by the player, a random number generator communicating with the processor selects an outcome from numerous possible winning and losing outcomes preset for the slot machine. The number of winning and losing outcomes may number in the thousands or millions. When the outcome has been selected, for electro-mechanical devices, the computer processor controls the reels to stop and align indicia on the reels along one or more paylines corresponding to the computer processor selected outcome. For video slot machines, the computer processor drives the video display to similarly display the reels stopping and to present an outcome along one or more paylines consistent with the outcome determined by the processor. If the symbols or indicia presented along the payline or paylines for the machine represent a winning outcome, the player is rewarded. Otherwise, the player loses his/her wager.

In such wagering games, players bet against the odds that a predetermined series of numbers or indicia will be displayed upon activation of a gaming device. In order to increase the player's interest in the game, various modifications of these wagering games have been tried which involve an element of player skill. The skill usually involves some form of manual dexterity. Although knowledge based trivia games are known to retain player interest over a long period of time, they have not been used for pari-mutuel betting.

A game disclosed U.S. Pat. No. 5,899,456 to Weinstock discloses a progressive trivia game for multiple players using a playing board, a six sided die, cards and a timer. The player's score is determined by the time taken to answer a question and the number of hints required by the player to answer the question. The player who requires the least number of hints and answers the most questions wins the game.

U.S. Pat. Nos. 5,759,101 and 5,916,024 to Von Kohorn are each directed to a game wherein correct answers to questions provide coupons for discounts on sponsors products. The patents also contemplate wagering on the outcome of skill-based events, such as sporting events.

U.S. Pat. No. 5,539,822 to Lett discloses an interactive television system wherein wagers can be placed on future events, such as the outcome of a horse race.

U.S. Pat. No. RE35,864 discloses electronic video games which provide for pari-mutuel betting.

An article by Ms. Carol Rust entitled "Electronic Trivia Game Takes Off In Popularity" which appeared in the *Houston Chronicle* in 1996 describes a television trivia game in which participants at remote locations answer trivia questions and obtain scores based on the number of correct answers selected.

Although each of the above-mentioned games are suitable for their intended purpose, none is directed to a knowledge based wagering game wherein a pari-mutuel format is used and the players' payout is determined by the correctness and speed with which the answers are given by a player vis-a-vis a pool of other players.

DISCLOSURE OF THE INVENTION

In accordance with this invention, a knowledge based wagering game is provided which affords a plurality of players an opportunity to place a wager on the game. A sequential series of inquiries are displayed to each player who must select a correct response from a plurality of possible responses within a predetermined period of time. The response selected by each player are recorded and the players are ranked with respect to all of the other players based on the number of correct responses selected and the amount of time taken to select each correct response. Under a pari-mutuel betting system, payouts are made in accordance with the players relative scores and the total amount wagered by all players in the game.

In a preferred embodiment of the method of the game, categories, such as history, science, geography, literature or politics, are identified to a population of individuals who are interested in playing a game. Those individuals are permitted to select a category. Players who select the same category are enrolled in the next game in that category and become the population of players for that particular game. Typically, the inquiries are ten questions which comprise each game. However, a greater or lesser number of questions can comprise each game. After enrollment, each player is allowed a predetermined amount of time to place a wager in an amount determined by the operator of the game. Alternatively, the operator can permit wagers to be placed between a predetermined minimum and maximum amount. The aggregate wagers make up a pari-mutuel handle for that game. The questions are then displayed in series along with a plurality of possible responses or answers to each question. The players are given a predetermined period of time in which to select an answer for each question. The quicker a player answers a question the higher the score received for that question. At the end of game, the winnings will be split out among the players based on a proprietary pari-mutuel formula. The operator receives its share of the handle before distribution is made to the players.

A number of variations of the game are possible. For example, player profiles and demographics can be developed for ranking and matching players by skill levels within any particular category. The list of possible answers for each question can remain for the entire time period permitted for answering each question or they can randomly or systematically be removed over the period of time remaining to answer the question. Opportunity can be provided for a player to change an answer during the answering period for that question. Also, players can be given opportunities to change their wager before the game begins or even during the course of the game.

Additional advantages of this invention will become apparent from the description which follows, taken in conjunction with the accompanying drawings.

BEST MODE FOR CARRYING OUT THE INVENTION

Figure 1:
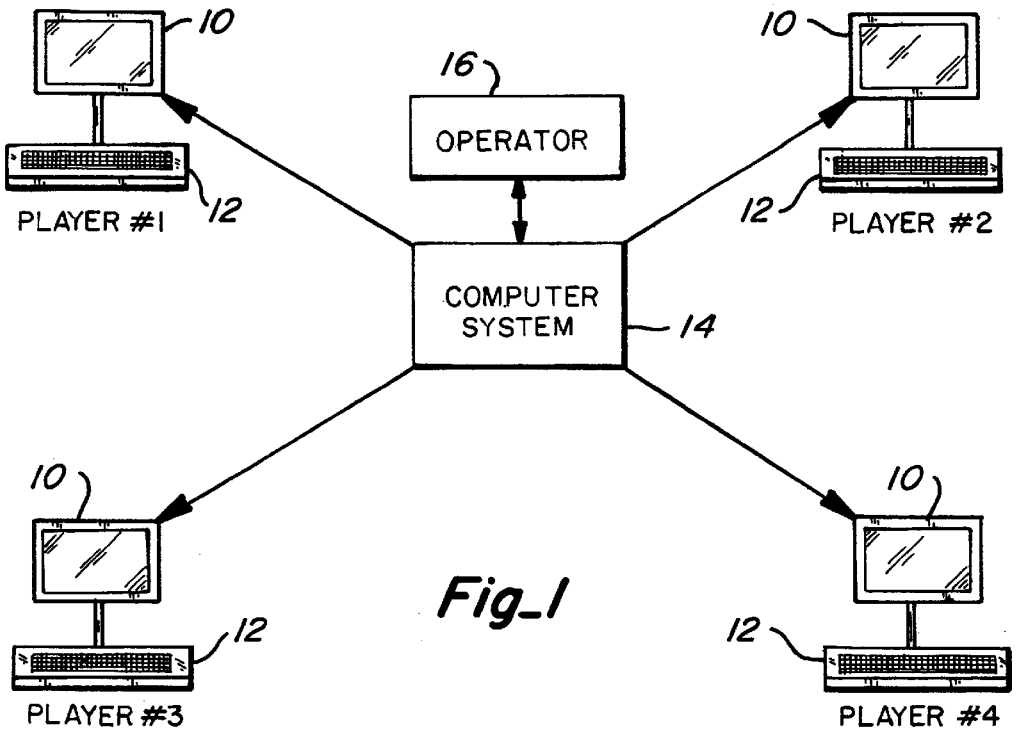
FIG. 1 is a diagrammatic illustration of relationship of players and operator with respect to playing a knowledge based wagering game in accordance with the method of this invention.

As seen in FIG. 1, each player has access to two items, a video display device 10 (that may or may not be an individual screen) and an input device that consists of some type of keyboard, touch screen or virtual reality device that allows players to input answers to questions. The method of this invention is illustrated and described herein by the use of an alpha-numeric keyboard 12 for inputting numeric data and touch screens for making selections as required both prior to the game and during the game. It will be understood that the selections made on the touch screens alternatively could be made through the keyboard, or alternatively, a telephone keypad. The touch screen and the input device may or may not be wireless. In some cases, the player may verbally deliver his/her answers to a game official employed by the operator. The operator is the licensed entity who oversees the operation of the game.

A computer system 14, including supporting software, records players' responses and interconnects each player with the operator 16. The computer system not only records the answer given, but also records how long the player waited to input the correct answer. Computer system 14 can be a network that allows players at remote locations to play a game. It should also be understood the network could provide for multiple games being played simultaneously at the various remote player locations. The network may be a cable, wireless, LAN, intranet, Internet, virtual private network, phone line, satellite transmission or any other mode of networking/connectivity.

Figure 2:
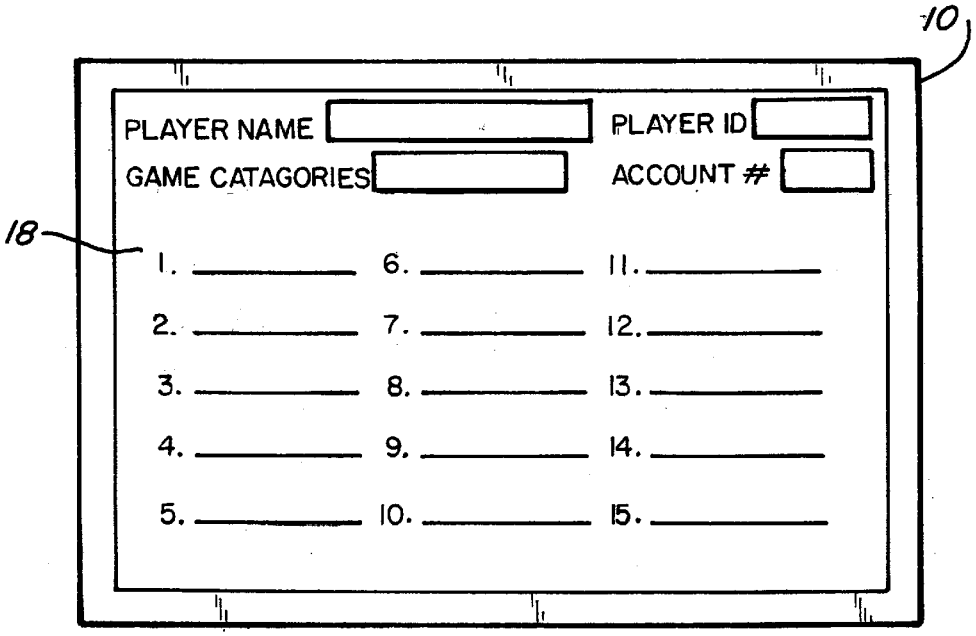
FIG. 2 is an illustration of a screen presented to each player from which to provide his/her identify and to select a game category.

The computer system 14 provides an initial or first game screen 18, shown in FIG. 2, to a population of individuals who are interested in playing a game. Individuals who wish to become players enter some type of identifying data into the computer system via the keyboard or touch screen (such as frequent player card, user name & password, personal code, credit card information). If the player is a first-time participant, the computer system will register the player, explain the rules and structure of the game and wagers. The computer system then recognizes and greets the player with a personalized message. Next the computer system alerts the player as to how long he/she will have to wait to participate in a game or if the player may join in a game immediately.

Figure 3:
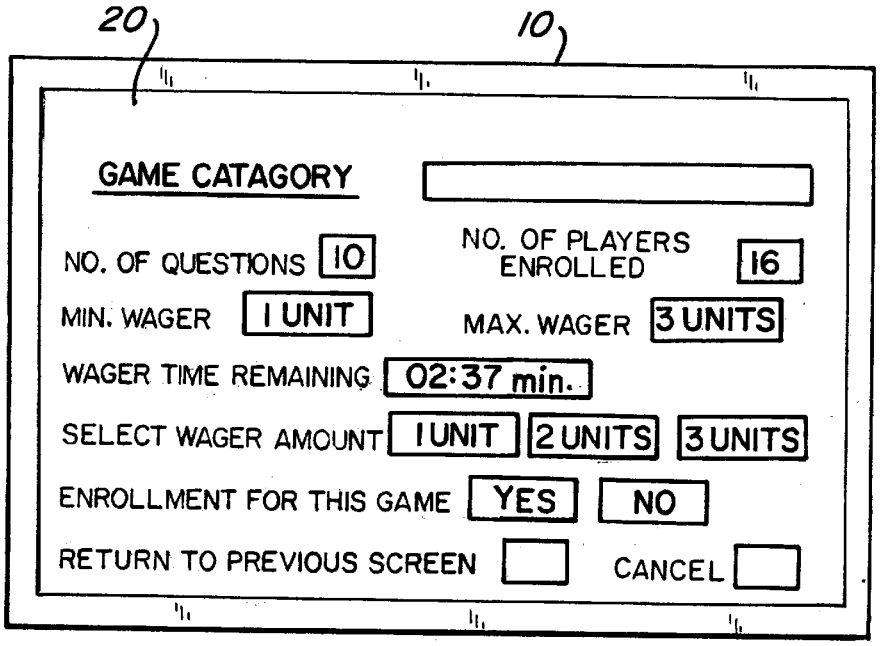
FIG. 3 is an illustration of a subsequent screen which allows the player to enroll in the game and place a wager.

Once the information required on first screen 18 is entered, a second screen, like screen 20 in FIG. 3, will appear which displays the game category, number of questions in the game, number of players in the game, the wagering units available for the game, the time remaining to place a wager and confirmation that the player wishes to be enrolled in the game. The player can respond by touching the appropriate boxes on screen 20.

Figure 4:
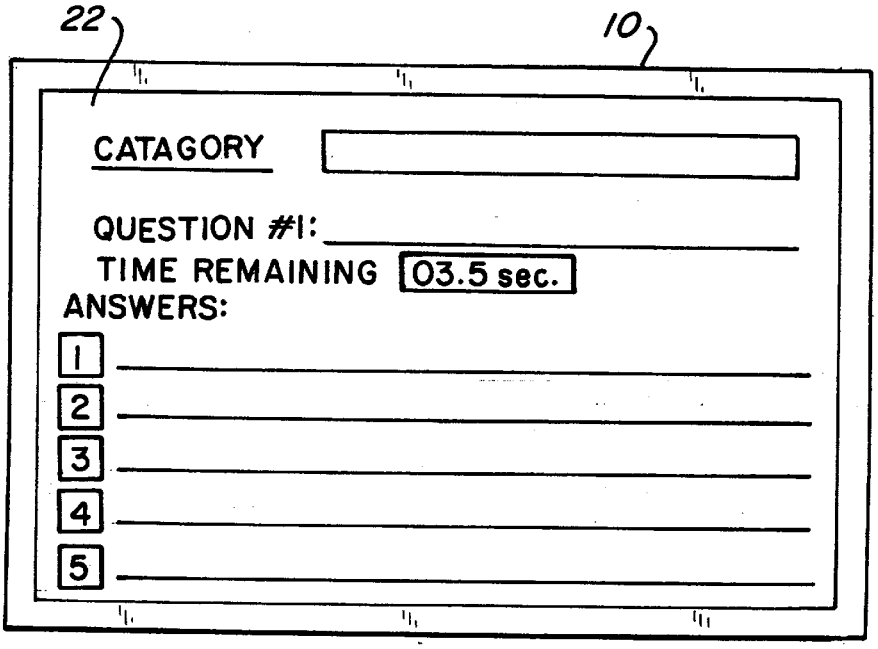
FIG. 4 is an illustration of a screen showing a question for the selected category and the possible answers from which the player chooses.

Next, a third screen, like screen 22 shown in FIG. 4, appears which provides the first question. The display shows the first category and displays the first question. After a predesignated amount of time, such as one to five seconds after the question is displayed, a multiple-choice list of four or five answers is displayed. The player then has a predesignated amount of time, such as fifteen to twenty seconds, to select an answer by pressing the corresponding key or button on the keyboard 12 or touch the appropriate box on screen 22. The operator has the ability to select from a variety of display modes during the fifteen to twenty seconds including but not limited to the following modes:

1. Static—the answer list remains for the entire period.
2. Removal—wrong answers are removed sequentially at a predetermined rate, such as one per five seconds, until only the correct answer remains at the end of the period.
3. Random Removal—random answers are removed at a predetermined rate, such as one per five seconds, until no answers remain.

When the player touches the numbered box next to the selected answer, the computer system determines whether the answer selected is correct and, if so, records the amount of time taken to answer it and assigns the appropriate number of points to that player vis-a-vis other players for the answer to that question. If a wrong answer is selected, the player receives no points for that selection or may be assessed penalty points.

Once the time for the first question to be answered has expired, another screen, which is not shown but is like screen 22, appears on each player's display device 10 with the second question and a plurality of possible answers. The players then select an answer as before. This process continues until all questions comprising the game have been sequentially displayed along with a plurality of possible answers for each. With each selection of an answer to each question, points are given to each player based on selecting the correct answer and the time taken to make the selection vis-a-vis the other players comprising the pool.

Figure 5:
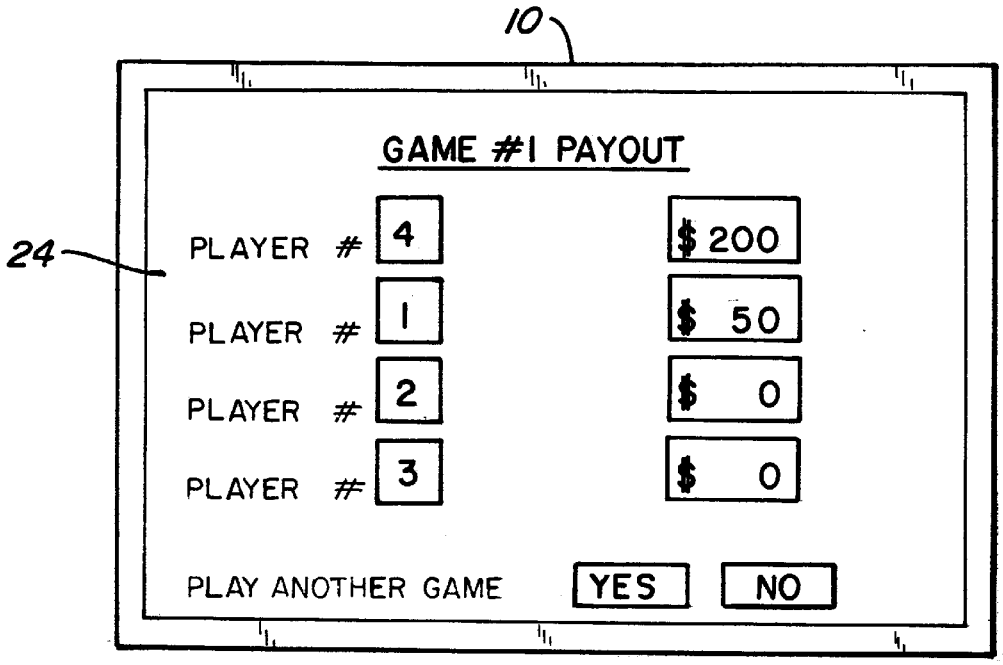
FIG. 5 is an illustration of a screen showing the payout for the game at the conclusion thereof.

After all questions have been answered, the computer system scores each player based on the percentage of questions answered correctly, and response time needed to answer questions. The computer system determines the rankings of the players and the payout based on the pari-mutuel handle and displays this information on a final screen, such as screen 24, shown in FIG. 5.

By way of example, assume ten players participate in a game with 100 points being the maximum amount of points available per question. Player "4" is the first player to supply the correct answer so that he/she receives 95 points. Player "1" is the next player to supply the correct answer and receives 88 points. The point value declines as time lapses and the player(s) who do not supply the correct answer receive zero points. Players who tie on particular questions receive the same number of points. A player who selects an incorrect answer either receives no points or is penalized a certain number of points. The computer system scores the players at the end of the game by adding up each player's point total from the series of questions (or for each question depending on the mode of play) and ranks them with respect to some preset criteria, such as against the universe or population of active players. Those players with the most points receive a proportionate share of the wager pool or handle, just as the winners in a horse race receive their pari-mutuel winnings.

The winning amounts shown on screen 24 can be automatically credited to the account(s) of the winning player(s) and each player can select whether or not to play another game. The next 30–60 seconds can be used to show advertising/promotional material, allow time for registering new players and allow existing players to change their preferences.

The computer system inputs the data collected with respect to each player playing the game and creates databases to create corresponding player profiles and demographics that can then be used for internal marketing efforts, and marketing to third parties. The computer system also ranks each player's skill level with respect to the universe of other players in the game. With this information the computer system can also create player levels such as quintiles, deciles or other numeric rankings. The computer system also has the ability to place players in competition with other players of similar skill levels by moving players into higher or lower skill categories, depending upon their performance relative to the universe of active players. This will prevent the highest-scoring players from dominating and allow the operator to host tournaments for different skill levels.

Other features can be provided by the computer system. The computer system can have the ability to present visual and/or auditory information to the player. As shown in FIG. 3, the computer system has the ability to alert the player as to how many other players are in the game. It can allow the player to play against a database universe generated by the computer system if there are not enough players. If the player competes against the universe, his/her winnings and losses may be determined by the player's ability to beat universe averages. The player who can beat the averages will collect a reward commensurate with the performance; for example, one scoring in the top 2% of performances will get a larger payout than one who scores only in the top 51% of performances.

If the player submits an answer and wants to change the answer before the round is over, he/she may do so by selecting another answer. Each change will require an additional wager and will erase the time of entry of the initial answer. The last selection will be the player's official answer for the purposes of recording the time and ranking the player for potential winnings. A player may change any answer until a predetermined time before the end of the allotted time for providing that answer, such as the last five seconds, or as long as there are at least two answers displayed.

Before the game begins the player can be provided with several wagering options:

1. Equal Wager—The equal wager option allows the player to bet the minimum amount required (which can be varied by the operator from location to location or even in different areas within a single location) or up to the maximum established by the operator. The equal wager option requires the player to have enough credits on the frequent player card, available credit on a credit/debit card or insert enough cash into an onsite receptacle. However, once the game begins, the player cannot deviate from the equal wager amount until the game is completed. The equal wager option requires that the player finish the game to collect any winnings.
2. Flexible Wager—The flexible wager option allows the player to bet the minimum or maximum amount he/she selects up to the maximum set by the operator. However, the player may change the wager amount from question to question, as long as he/she does so before the next question is displayed. The flexible option requires that the player finish the game to collect any winnings.
3. Single Mode Wager—The single mode wager option allows the player the most flexibility, giving him/her the ability to wager the minimum amount, or up to the maximum on each question. However, unlike the previous options, each individual question in the single mode wager option is a separate game. The players in the single mode wager option will participate in a distinct player pool. Winnings are calculated and paid out after each question is finished. Once a game is available, the computer system alerts the player that a new game is about to begin.

A game has been previously defined as a set of questions, usually ten. Any number of variations to the games can be provided. The following are a few examples of those variations. The operator has the ability to vary the number of questions per game, length of time between questions, and the types of questions. In some games, all the questions may involve a particular area of knowledge. In other games the highest-scoring player may determine the category from a list presented by the computer system. In other games, the category may be determined by popular vote among the participants. Most games will involve a variety of categories randomly selected by the computer system. A complete game and will last approximately 4–5 minutes and run during selected hours, or run continuously 24 hours a day, 7 days per week, depending on operator preference.

The pari-mutuel handle is made up of the aggregate wagers placed by the participants in any particular game. The operator can limit the pool to certain groups, skill levels, areas in a competition, for example, high rollers only, or geographic regions. The operator can conduct nationwide or worldwide competitions. Sponsor and/or advertising fees may be added to the handle. The participants who supply the correct answer to each question will receive the majority of the winnings. A proprietary pari-mutuel formula will govern how the winnings are split out among the participants. The formula will tap into player psychology in an attempt to encourage a high level of player participation. The operator will receive its share of the handle before distributions are made to participants.

Multiple players may join together to form a team, but must register as a team and place a minimum wager according to a predetermined formula, such as:

minimum wager per player (or any wager above the minimum) X number of team participants=wager per round/question. This formula also applies to second chance wagers, i.e., wagers placed when an answer is changed. This rule is enforced through game attendants and electronic surveillance.

The examples mentioned above illustrate the basis of the game. However, the examples below show how the game can provide the necessary framework for the following other popular gaming formats:

1. The computer system formulates the inquiry in the form of an answer and the player selects from a list of possible responses in the form of questions.
2. The player types in the actual answer, rather than selecting from a list of multiple-choice answers.
3. The player wagers on providing correct responses in the form of certain letters needed to complete an inquiry in the form of a partial word, symbol or phrase, e.g., similar to the game "Hangman."
4. Another variation is the game show-type environment where the players compete in a designated area and there is a host acting as master of ceremonies. The game show format could be broadcast over radio, Internet, satellite, cable or any other means of transmission.

Certain restrictions apply to all players:

1. Anyone giving advice, answers, or any other type of feedback is determined to be a team participant and is required to wager the same amount as the participant.
2. No participant can receive advice, answers, or any other type of feedback via any type of information delivery device or object whether that object be electronic or otherwise. These objects include but are not limited to reference material, computers, calculators, telephones, etc.

From the foregoing, the advantages of this invention are readily apparent. A method of playing a knowledge based wagering game is provided wherein each player competes against other players or a statistical pool of players in answering a series of questions making up a game on some area of trivia knowledge. Each player's score is determined by the number of correct answers given and the speed with which the correct answers are given. Numerous variations can be made in the game at the option of the players and/or operator.

This invention has been described in detail with reference to particular embodiments thereof, but it will be understood that various other modifications can be effected within the spirit and scope of this invention.

What is claimed is:

1. A method of playing a knowledge based wagering game comprising:

identifying a knowledge based game to a plurality of individuals;

enrolling a plurality of the individuals as active players for the game whose subsequent scores form a universe of competing players;

affording each player an opportunity to place a wager on the game;

accepting the wager from each player to form a wager pool;

displaying to each player a sequential series of inquiries and providing a plurality of possible responses to each inquiry;

affording each player a predetermined period of time in which to select a response from the plurality of possible responses for each sequentially displayed inquiry;

recording the responses selected by each player and the time taken by each player to select each response to each inquiry;

determining each player's ranking with respect to the universe of players;

displaying to all of the players each player's ranking and any amount won by each player; and paying out the amount won by each player.

2. A method of playing a knowledge based wagering game, as claimed in claim 1, including the further step of:

setting a minimum and maximum wager before any of the players place a wager.

3. A method of playing a knowledge based wagering game, as claimed in claim 1, wherein:

the payout is commensurate to each of the players ranking with respect to each of the other players.

4. A method of playing a knowledge based wagering game, as claimed in claim 1, wherein:

the players are ranked by a point system assigned to each inquiry based on the amount of time required by each player to give a correct response to each inquiry.

5. A method of playing a knowledge based wagering game, as set forth in claim 1, comprising the further step of:

advising each of the players when the game will begin.

6. A method of playing a knowledge based wagering game, as set forth in claim 1, comprising the further step of:

advising each of the players of the total time required to play the game.

7. A method of playing a knowledge based wagering game, as claimed in claim 1, including the further step of:

varying the length of time between inquiries.

8. A method of playing a knowledge based wagering game, as claimed in claim 1, including the further steps of:

assigning point values to each inquiry;

assigning points to players selecting the correct response in descending values based on the elapsed time taken to select the correct response;

totaling the points for each player at the end of the game;

ranking the players against the universe of active players; and paying the players with the most points a proportionate share of the wager pool.

9. A method of playing a knowledge based wagering game, as claimed in claim 8, including the further step of:

penalizing players a predetermined number of points for selection of an incorrect response.

10. A method of playing a knowledge based wagering game, as claimed in claim 1, including the further step of:

determining profile information for each player.

11. A method of playing a knowledge based wagering game, as claimed in claim 10, wherein:

the profile information is demographic information.

12. A method of playing a knowledge based wagering game, as claimed in claim 10, including the further steps of:

creating different player skill levels based on the profile information; and moving the players from one skill level to another based on each individual player's skill level.

13. A method of playing a knowledge based wagering game, as claimed in claim 1, including the further step of:

affording the plurality of players an opportunity to select a game category by a majority vote.

14. A method of playing a knowledge based wagering game, as claimed in claim 1, including the further steps of:

allowing at least some of the plurality of players to play as a team; and requiring each team to place a separate wager for each member of that team.

15. A method of playing a knowledge based wagering game, as claimed in claim 1, including the further step of:

providing wager options for each of the players.

16. A method of playing a knowledge based wagering game, as claimed in claim 1, including the further step of:

identifying the number of players in each game to all of the other players enrolled in the game.

17. A method of playing a knowledge based wagering, game, as claimed in claim 1, including the further step of:

permitting each of the players to change one or more responses before the time period expires.

18. A method of playing a knowledge based wagering game, as claimed in claim 1, including the further steps of:

setting up a pari-mutuel handle from the aggregate wagers placed on each game by all of the players; and determining the game operator's share of the handle prior to payout to the players.

19. A method of playing a knowledge based wagering game, as claimed in claim 18, including the further step of:

adding sponsor fees to the handle before determining the payout to the operator and the players.

20. A method of playing a knowledge based wagering game, as claimed in claim 18, including the further step of:

adding advertising fees to the handle before determining the payout to the operator and the players.

21. A method of playing a knowledge based wagering game, as claimed in claim 1, wherein:

the inquiry is a question;

the plurality of possible responses is a plurality of possible answers; and the response selected by each of the players is an answer selected from the plurality of possible answers.

22. A method of playing a knowledge based wagering game, as claimed in claim 1, wherein:

the inquiry is an answer to a question;

the plurality of possible responses is a plurality of possible questions; and the response selected by each of the players is a question selected from the plurality of possible questions.

23. A method of playing a knowledge based wagering game, as claimed in claim 1, wherein:

the inquiry is a partial word, phrase or symbol;

the plurality of possible responses is a plurality of possible letters and/or symbols for completing the partial word, phrase or symbol; and the response selected by each of the players is one of the plurality of possible letters and/or symbols selected from the plurality of possible letters and/or symbols.

* * * * *